United States Patent [19]

Hensbo

[11] Patent Number: 4,467,528

[45] Date of Patent: Aug. 28, 1984

[54] PARALLEL RULER

[76] Inventor: Lars C. Hensbo, Vejlands Alle 139, Copenhagen, Denmark

[21] Appl. No.: 345,695

[22] Filed: Feb. 4, 1982

[30] Foreign Application Priority Data

Feb. 9, 1981 [DK] Denmark ..... 541/81

[51] Int. Cl.[3] ..... B43L 5/00

[52] U.S. Cl. ..... 33/444; 33/448

[58] Field of Search ..... 33/444, 445, 446, 448, 33/454, 464, 489, 493, 483

[56] References Cited

U.S. PATENT DOCUMENTS

| | | | |
|---|---|---|---|
| 3,106,783 | 10/1963 | Justis | 33/444 |
| 3,283,410 | 11/1966 | Truhon | 33/444 |
| 3,374,546 | 3/1968 | Justis, Sr. | 33/444 |
| 3,425,128 | 2/1969 | Cooper | 33/444 |

*Primary Examiner*—Willis Little

*Attorney, Agent, or Firm*—Holman & Stern

[57] ABSTRACT

A ruler, especially a parallel ruler having a parallel guidance system comprising a cord (6) extending between four points (A,B,C&D) and crossing itself diagonally in a corner to corner-fashion in the central portion of the ruler, which ruler consists of two flexible parts, a ruler body (1) and a finger rail (2) being in slidable engagement by dovetailing (9) and having clamping devices in both ends in the form of a tapped sleeve (3) and a screw (4) in holes (7), whereby, upon imparting upon the two parts a differently curved shape, the two parts may be clamped together showing a rise of the arch of the ruler, so that the ruler will more easily be pulled over the surface of the drawing-board.

The central portion of the finger rail (2) may be removed, whereby the cord (6) may cross itself in this cut away-area (8). Such cord will not hamper the draftsman and will still be easily accessible for check and repair.

4 Claims, 8 Drawing Figures

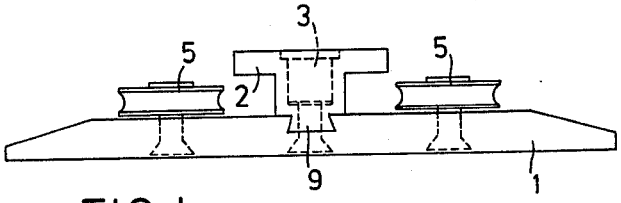
FIG. 1
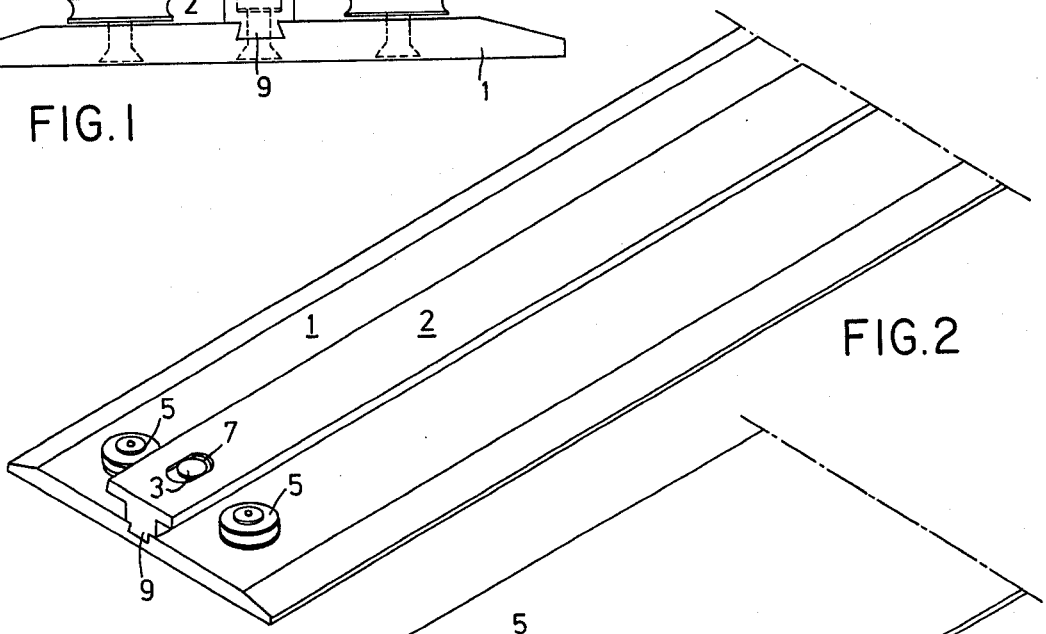
FIG. 2
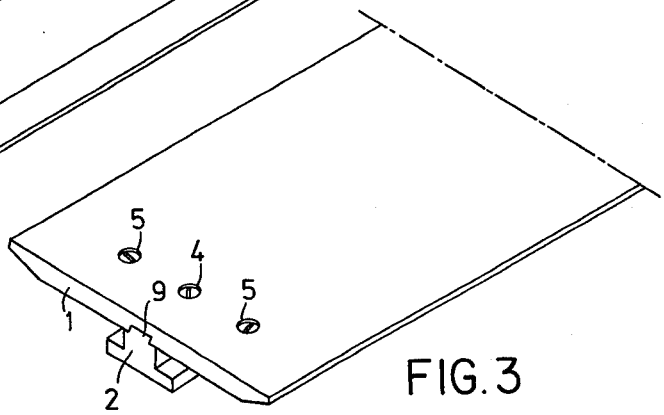
FIG. 3
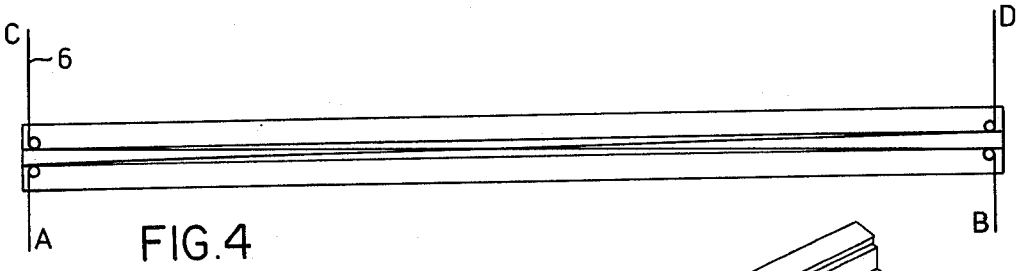
FIG. 4
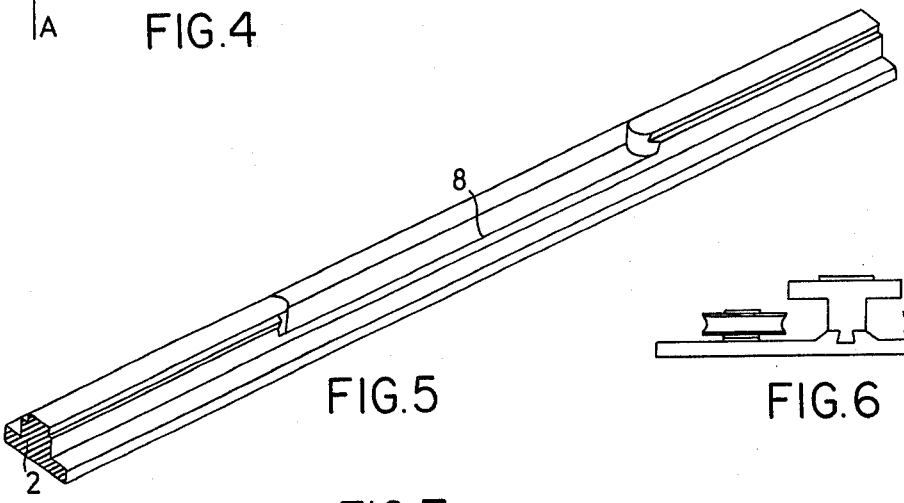
FIG. 5
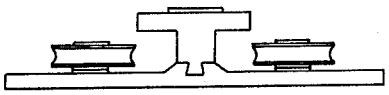
FIG. 6
FIG. 7
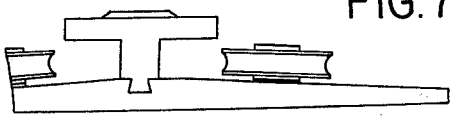
FIG. 8
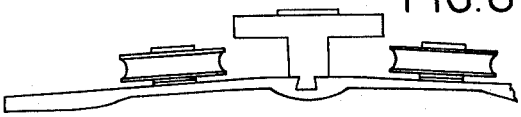

PARALLEL RULER

The present invention relates to an arrangement in long rulers, preferably of the type which has a parallel guidance system by means of cords or similar flexible bodies having parts thereof being substantially perpendicular to the ruler at two opposite edges of the ruler and having parts of the cord crossing each other in the longitudinal direction of the ruler.

From U.S. Pat. No. 3,425,128 there is known a ruler having a pressure applying means or a tension member forcing the portion thereof intermediate its ends upwardly in spaced relation to the drawing surface, i.e. providing a rise of the arch of the ruler. However, the said tension member does not constitute a natural part of the ruler proper but is an added extraneous member extending all over the length of the ruler.

An object of the present invention is to suggest a new ruler, especially a parallel ruler of the type guided by a cord, having an easily obtainable and easily adjustable rise of the arch thereof, this object being obtained in a ruler which is not likely to be unintentionally deformed, or even damaged due to, say, an excessive tightening of a screw.

Another object of the invention is to suggest a new parallel ruler guided by a cord in which the cord is positioned in such manner that it does not hamper the draftsman and is still easily accessible for check or repair.

Still another object of the invention is to suggest a ruler which only consists of few parts and is therefore easy to manufacture.

In accordance with the invention there is provided a ruler, especially a parallel ruler having a parallel guidance system comprising a cord extending between four points and crossing itself diagonally in a corner to corner-fashion in the central part of the ruler, which ruler consists of two flexible parts, a ruler body and a finger rail being in slidable engagement such as by dovetailing and having clamping devices such as sleeves and screws in holes whereby, upon imparting upon the two parts a differently curved shape, the two parts may be clamped together showing a rise of the arch of the ruler.

There may be one fixed clamping device in one end of the ruler received in flushing circular holes in the ruler body and in the finger rail, and one slidable clamping device in the other end of the ruler received in, for instance, a circular hole in the ruler body and an oblong hole in the finger rail; or there may be slidable clamping devices in both ends.

The central portion of the finger rail may be removed whereby the cord may cross itself in this cut away-area.

Thanks to the adjustable rise of the arch it is possible to reduce the frictional resistance and, in some materials, also the suction resistance between the drawing-board and ruler to a minimum and at the same time it will be possible to adjust the rise of the arch individually with a view to various circumstances such as different kinds of drawing-paper.

A suitable embodiment brings about the following advantages, among other things: The ruler can be used in its full length and is equally well suited for right-handed and left-handed persons and the location and the height of the finger rail provides a good drawing position for the draftsman and a good and natural support for the hand. Furthermore, one edge of the ruler may be a drawing ink edge so that a single ruler may be used for both drawing ink and pencil. It is also possible to make the ruler of several materials and thereby to obtain several advantages and to widen the potential market to several lines of trade, especially by means of a cut-proof embodiment in which case trades may come into consideration where cutting and mounting takes place.

The construction principle gives rise to a rigid ruler having enhanced stability.

To a certain degree, a raw materials saving is obtained since the thickness of the profiles may be reduced, and its simple construction requires a modest number of man-hours of manufacture only.

The drawing shows an embodiment in which

FIG. 1 is a sectional view of the ruler body and the finger rail, also showing the cord-guiding pulleys and the clamping devices of the finger rail.

FIG. 2 shows the ruler from above, with pulleys and the adjustable clamping devices of the finger rail.

FIG. 3 shows the ruler from below, with screws for the pulleys and fixation screw for the sleeve of the clamping device.

FIG. 4 shows the arrangement of the cord, schematically, together with the ruler.

FIG. 5 shows the central portion of the finger rail having some of the material removed so that the cord may cross itself.

FIGS. 6, 7 and 8 show various profile shapes which are useful for different materials and different ways of manufacture.

As shown in FIG. 1, the ruler consists of a ruler body 1 carrying pulleys for a cord (6 in FIG. 4) and a finger rail 2. The ruler body and the finger rail 2 are in slidable engagement by means of a dovetailing 9. For clamping this engagement in any desired position there are provided in each end of the ruler a sleeve 3 received in oblong holes 7 (FIG. 2) or in one oblong and one circular hole in the finger rail, and a clamping screw 4 (FIG. 3) at the under side of the ruler.

The cord takes the longitudinal direction of the ruler and passes over all pulleys 5 and is fastened to the drawing-board in points A, B, C and D.

FIG. 5 shows part of the finger rail in which the central portion 8 of the foot of the rail has been removed so that the cord may cross itself here.

The rise of the arch of the ruler is adjusted by placing the latter on a plane support, resting on the finger rail (upside down), and loosening the clamping screws 4 of the sleeves in both ends; then the end points of the finger rail are raised some millimeters, the central part of the ruler is pressed against the support and the clamping screws are tightened in the sleeves. The shape of the ruler body and of the finger rail is retained, all in accordance with the size of the rise of the arch, the length of the ruler and rigidity of the material so that, in use, the central part of the ruler will rest with a few grams only on the drawing-board or will not touch it at all. In return, the major part of the weight of the ruler will rest in two small areas at the ends of the ruler which are small compared to the length of the ruler. This will reduce the suction and frictional resistance to a minimum and make the handling of the ruler much easier.

I claim:

1. In a parallel ruler of the type including a flexible longitudinally extending ruler body having opposing parallel longitudinal edges and a flexible, longitudinally coextensive finger rail slidably engageable with said ruler body, the improvement comprising retaining means for retaining the ruler body in a bowed configuration after flexion thereof to impart radial stress to said ruler body, said retaining means including clamping means integrally associated with each end of the ruler for clamping said finger rail to said ruler body in adjustable longitudinal relationship to retain said ruler body in the desired degree of curvature, wherein the clamping means at one end of the ruler comprises an element that is longitudinally adjustable, and the clamping means at the other end of the ruler does not comprise such longitudinally adjustable element.

2. In a parallel ruler of the type including a flexible longitudinally extending ruler body having opposing parallel longitudinal edges and a flexible, longitudinally coextensive finger rail slidably engageable with said ruler body, the improvement comprising retaining means for retaining the ruler body in a bowed configuration after flexion thereof to impart radial stress to said ruler body, said retaining means including clamping means integrally associated with each end of the ruler for clamping said finger rail to said ruler body in adjustable longitudinal relationship to retain said ruler body in the desired degree of curvature, wherein at least one of said clamping means includes a longitudinally extending slot in said finger rail to accommodate movement of a clamping element fixed in said ruler body along the longitudinal axis of said finger rail.

3. The ruler of claim 1, wherein said clamping element comprises a tapped sleeve engageable with said slot for receiving a corresponding screw.

4. The ruler of claim 1, 2 or 3, wherein the ruler is of the type further including a pulley and cord parallel guidance system.

* * * * *